US011571355B2

(12) United States Patent
Bae et al.

(10) Patent No.: US 11,571,355 B2
(45) **Date of Patent: *Feb. 7, 2023**

(54) METHOD OF CORRECTING THE PREDICTED ACUPUNCTURE POINT POSITION AND A MASSAGE CHAIR TO DO THIS

(71) Applicant: COWAY Co., Ltd., Gongju-si (KR)

(72) Inventors: Byoung Chan Bae, Seoul (KR); Kyung Hwan Park, Seoul (KR)

(73) Assignee: COWAY Co., Ltd., Gongju-si (KR)

( * ) Notice: Subject to any disclaimer, the term of this patent is extended or adjusted under 35 U.S.C. 154(b) by 388 days.

This patent is subject to a terminal disclaimer.

(21) Appl. No.: 16/643,700

(22) PCT Filed: Sep. 3, 2018

(86) PCT No.: PCT/KR2018/010221
§ 371 (c)(1),
(2) Date: Mar. 2, 2020

(87) PCT Pub. No.: WO2019/045542
PCT Pub. Date: Mar. 7, 2019

(65) Prior Publication Data

US 2020/0197255 A1 Jun. 25, 2020

(30) Foreign Application Priority Data

Sep. 4, 2017 (KR) ..... 10-2017-0112514

(51) Int. Cl.
*A61H 15/00* (2006.01)
*A47C 31/00* (2006.01)
(Continued)

(52) U.S. Cl.
CPC ..... *A61H 15/00* (2013.01); *A47C 7/503* (2013.01); *A47C 7/72* (2013.01); *A47C 31/008* (2013.01);
(Continued)

(58) Field of Classification Search
CPC .... A61H 15/00; A61H 15/02; A61H 15/0078; A61H 39/04; A61H 2201/5064;
(Continued)

(56) References Cited

U.S. PATENT DOCUMENTS 6,117,094 A * 9/2000 Fujii ..... A61H 39/04 601/102
8,282,584 B2 10/2012 Tsukuda et al.
(Continued)

FOREIGN PATENT DOCUMENTS

CN 1292672 A 4/2001
JP 11 -42263 A 2/1999
(Continued)

OTHER PUBLICATIONS

Combined Chinese Office Action and Search Report dated Jul. 14, 2021 in Patent Application No. 2018800696758 (with English translation of Category of Cited Documents), citing document AO therein, 7 pages.
(Continued)

*Primary Examiner* — Colin W Stuart
*Assistant Examiner* — Douglas Y Sul
(74) *Attorney, Agent, or Firm* — Oblon, McClelland, Maier & Neustadt, L.L.P.

(57) ABSTRACT

A method for correcting a massage position and a massage chair for performing the same includes allowing a shoulder height measurement module to measure a shoulder height of a user, allowing a hip bone position prediction module to predict a hip bone position through a preset prediction
(Continued)

method by using the shoulder height measured by the shoulder height measurement module, allowing a massage position determination module to determine a plurality of determination massage positions and a plurality of correction massage positions spaced from the determination massage positions by a predetermined distance on the basis of the hip bone position predicted by the hip bone position prediction module, and allowing a massage ball assembly control module to control a massage ball assembly so as to massage the determination massage positions and the correction massage positions determined by the massage position determination module.

5 Claims, 11 Drawing Sheets

(51) Int. Cl.

| | |
|---|---|
| ***A47C 31/12*** | (2006.01) |
| ***A61H 39/02*** | (2006.01) |
| ***A61H 39/04*** | (2006.01) |
| ***A47C 7/50*** | (2006.01) |
| ***A47C 7/72*** | (2006.01) |

(52) U.S. Cl.
CPC ..... *A47C 31/126* (2013.01); *A61H 39/02* (2013.01); *A61H 39/04* (2013.01); *A61H 2015/0042* (2013.01); *A61H 2201/0103* (2013.01); *A61H 2203/0431* (2013.01); *A61H 2230/825* (2013.01)

(58) Field of Classification Search
CPC .... A61H 2201/5023; A61H 2201/0149; A61H 2201/0142; A61H 2201/0146; A61H 2201/50; A61H 2201/1669; A61H 2205/081; A61H 2230/82; A61H 2230/825; A61H 2230/85; A61H 2230/855
See application file for complete search history.

(56) References Cited

U.S. PATENT DOCUMENTS

| | | | | |
|---|---|---|---|---|
| 2002/0082534 | A1* | 6/2002 | Jikiba | A61H 15/0078 601/99 |
| 2007/0225624 | A1* | 9/2007 | Tsukada | A61H 15/0078 601/49 |
| 2009/0005715 | A1* | 1/2009 | Taniguchi | A61H 23/02 601/99 |
| 2011/0275968 | A1* | 11/2011 | Liu | A61H 7/007 601/134 |
| 2014/0371638 | A1* | 12/2014 | Lee | A61H 15/0078 601/18 |
| 2017/0258673 | A1* | 9/2017 | Inada | A61H 9/0078 |
| 2020/0170882 | A1* | 6/2020 | Park | A61H 1/00 |

FOREIGN PATENT DOCUMENTS

| | | | |
|---|---|---|---|
| JP | 2002-35070 | A | 2/2002 |
| KR | 10-0726805 | B1 | 6/2007 |
| KR | 10-2007-0070134 | A | 7/2007 |
| KR | 10-2009-0027271 | A | 3/2009 |
| KR | 10-2011-0112911 | A | 10/2011 |
| KR | 10-2016-0119995 | A | 10/2016 |
| WO | WO 00/41667 | A1 | 7/2000 |

OTHER PUBLICATIONS

International Search Report dated Dec. 17, 2018 in PCT/KR2018/010221 filed on Sep. 3, 2018 citing documents AA-AB and AO-AS therein, 2 pages.

* cited by examiner

FIG. 4

| Location | Acupuncture point | Massage ball |
|---|---|---|
| Between C1 and C2 | An myeon | Upper massage ball (720) |
| Between C1 and C2 | Pung bu | |
| C2 | Cheon ju | |
| C2 | Pung ji | |
| C7 | Gyeon jeong | |
| C7 | Gyeon jung su | |
| T1 | Gyeon oe su | Lower massage ball (730) |
| T2 | Ji su | |
| Between T6 and T6 | Sim su | |
| Between T6 and T7 | Yeong dae | |
| Between T7 and T8 | Dok su | |
| Between T7 and T8 | Eu Hoe | |
| Between T8 and T9 | Gyeok su | |
| Between T8 and T9 | Gyeok gwan | |
| Between T8 and T9 | Ji yang | |
| Between T9 and T10 | Hon mun | |
| Between T9 and T10 | Gan su | |
| Between T10 and T11 | Dam su | |
| Between T10 and T11 | Yang gang | |
| Between T11 and T12 | Bi su | |
| Between T11 and T12 | Eu sa | |
| Between T12 and L1 | Wi su | |
| Between T12 and L1 | Wi chang | |
| Between L1 and L2 | Sam cho su | |
| Between L2 and L3 | Sin su | |
| Between L2 and L3 | Ji sil | |
| Between L2 and L3 | Myeong mun | |
| Between L3 and L4 | Gi hae su | |
| Between L4 and L6 | Dae jang su | |
| Between L4 and sacrum | Gwan won su | |
| sacrum | So jang su | |
| sacrum | Band gwang su | |
| sacrum | Sang ryo | |
| coccyx | Mi gol dan | |
| coccyx | Cha ryo | |

700

METHOD OF CORRECTING THE PREDICTED ACUPUNCTURE POINT POSITION AND A MASSAGE CHAIR TO DO THIS

TECHNICAL FIELD

The present invention relates to a method for correcting acupuncture positions and a massage chair for performing the same, and more particularly to a method for correcting predicted acupuncture positions and a massage chair for performing the same, by which acupuncture positions can be predicted and an error of the predicted acupuncture positions can be reduced.

BACKGROUND ART

Numerous people receive massages to resolve the bodies stiffened by stresses and stiff muscles due to lack of exercises. However, for various reasons, people cannot receive massages by massage experts, and massage chairs that are provided at home to be conveniently used have been developed and used.

In addition, in recent years, because the acupuncture points distributed in the human body have been massaged on the basis of Korean medical systems as well as specific body portions simply have been massaged or acupressure has been applied to the specific body portions, interests for the methods for solving fatigues of the user and maintain health have been increased.

However, the body conditions of the users are different. That is, various factors, such as height, weight, sex, and age, which can influence the state of the body are present, and accordingly, the acupuncture positions may be different.

Accordingly, it has been recognized that it is more effective to visit Korean medical hospitals and directly receive a therapy from a Korean medical doctor rather than using a massage chair in order to receive massages that are suitable for different acupuncture positions of the users.

Accordingly, massage chairs equipped with a function of massaging acupuncture points, which overcome massage chairs that simply massage specific portions such as shoulders, arms, and legs by delivering a pressing feeling through airbags or delivering an acupressure feeling through massage balls have been released.

However, the acupuncture positions of the user may be different due to different body shapes. Therefore, it is more preferable to perform massages after finding out different acupuncture positions of the users rather than massage the same acupuncture positions by a massage chair.

Korean Patent Application Publication No. 10-2011-0112922 discloses a massage chair that can massage acupuncture points distributed along five meridian system stems of the back of the user. Specifically, a massage chair that can massage acupuncture points distributed along a spine by using a spine aeremia communicator including a combination of a plurality of bars that apply a pressure due to the weight of the user on the inside of a back support.

However, because this type of massage chair always massages the same acupuncture points along a manner that are input in advance without a separate acupuncture position searching process, it is difficult to reflect different acupuncture positions for different users.

As another example, Korean Patent Application Publication No. 10-2016-0119995 discloses a pneumatic massage machine that can be used for a massage chair for massaging acupuncture points. Specifically, a pneumatic massage machine that can perform a massage function while forming acupressure bosses on the inside of the pneumatic massage machine that contacts the skin of a human body, and also can massage the acupuncture points of the human body while including acupuncture bosses at specific locations.

However, this type of pneumatic massage machine can also perform massages of acupuncture points on specific locations regardless of different acupuncture positions of the users, and therefore, it is impossible to provide massages specified for acupuncture points to the users.

(Patent Document 1) Korean Patent Application Publication No. 10-2011-0112911 (Oct. 14, 2011)

(Patent Document 2) Korean Patent Application Publication No. 10-2016-0119995 (Oct. 17, 2016)

DISCLOSURE

Technical Problem

Accordingly, the present invention provides a correction method and a massage chair for performing the same, by which different acupuncture positions can be predicted for different users by using hip bone positions and height information and errors of the predicted acupuncture positions can be reduced.

Technical Solution

To achieve the objectives, the present invention provides a method for correcting massage positions, the method including: (a) measuring the shoulder height of a user, by a shoulder height measurement module (610); (b) predicting a hip bone position through a preset prediction method by using the shoulder height measured by the shoulder height measurement module (610), by a hip bone position prediction module (610); (c) determining a plurality of determination massage positions and a plurality of correction determination massage positions spaced apart from the massage positions by predetermined distances with reference to the hip bone position predicted by the hip bone position prediction module (620), by a massage position determination module (630); and (d) controlling a massage ball assembly (700) to massage the determination massage positions and the correction massage positions determined by the massage position determination module (630), by a massage ball assembly control module (640)

Further, the predetermined distances may include a first distance and a second distance; the correction massage positions may include a first correction massage position spaced by the first distance to the upper side of the determination massage positions and a second correction massage position spaced by the second distance to the lower side of the determination massage positions; and the first distance and the second distance may be different according to positions of vertebrae that are adjacent to the massage positions.

Further, the preset prediction method may include: when the shoulder height measured in (a) is less than a first shoulder height value, predicting the hip bone position as a predetermined first hip bone position, by the hip bone position prediction module (620); when the shoulder height measured in (a) is not less than the first shoulder height value and less than a predetermined second shoulder height value, predicting the hip bone position as a predetermined second hip bone position, by the hip bone position prediction module (620); and when the shoulder height measured in (a) is not less than the second shoulder height value, predicting the hip bone position as a predetermined third hip bone position, by the hip bone position prediction module (620), and the second shoulder height value may be larger than the first shoulder height value, and the second hip bone position value may be larger than the first hip bone position value and is smaller the third hip bone position value.

Further, the method may further include after (d), (e) massaging the determination massage positions, by the massage ball assembly (700); (f) moving the massage ball assembly (700) through a preset movement scheme when the massage ball assembly (700) is moved from the determination massage positions to the correction massage positions; and (e) massaging the correction massage positions, by the massage ball assembly (700), and in the preset movement scheme, the massage ball assembly (700) is moved while being rotated circularly.

Further, the method may further include: after (c) and before (d), (c1) receiving height information of the user, by a user height information input module (650); and (c2) correcting the hip bone position predicted by the hip bone position prediction module (620) by using the height information received by the user height information input module (650), by a hip bone position correction module (660).

Further, the method may further include: determining the plurality of determination massage positions and the plurality of correction massage positions spaced apart from the determination massage positions by the predetermined distances with reference to the hip bone position corrected by the hip bone position correction module (660), by the massage position determination module (630).

The present invention also provides a massage chair that performs the method for correcting massage positions.

Advantageous Effects

According to the present invention, because massages are performed by predicting hip bone positions of a user with reference to shoulder heights of the user and predicting the acupuncture positions with reference to the predicted hip bone positions, specified massages can be provided to different acupuncture positions of users.

Further, the precision of prediction of acupuncture positions can be further improved by correcting the hip bone positions predicted by using height information of the user.

Moreover, because massages are additionally performed on the upper and lower positions of the predicted acupuncture positions as well as the predicted acupuncture positions, an error of the predicted acupuncture positions can be reduced.

DESCRIPTION OF THE DRAWINGS

FIG. 4 is a view illustrating acupuncture points located around the vertebrae of FIG. 3 and massage balls for massaging the acupuncture points.

BEST MODE

Figure 1:
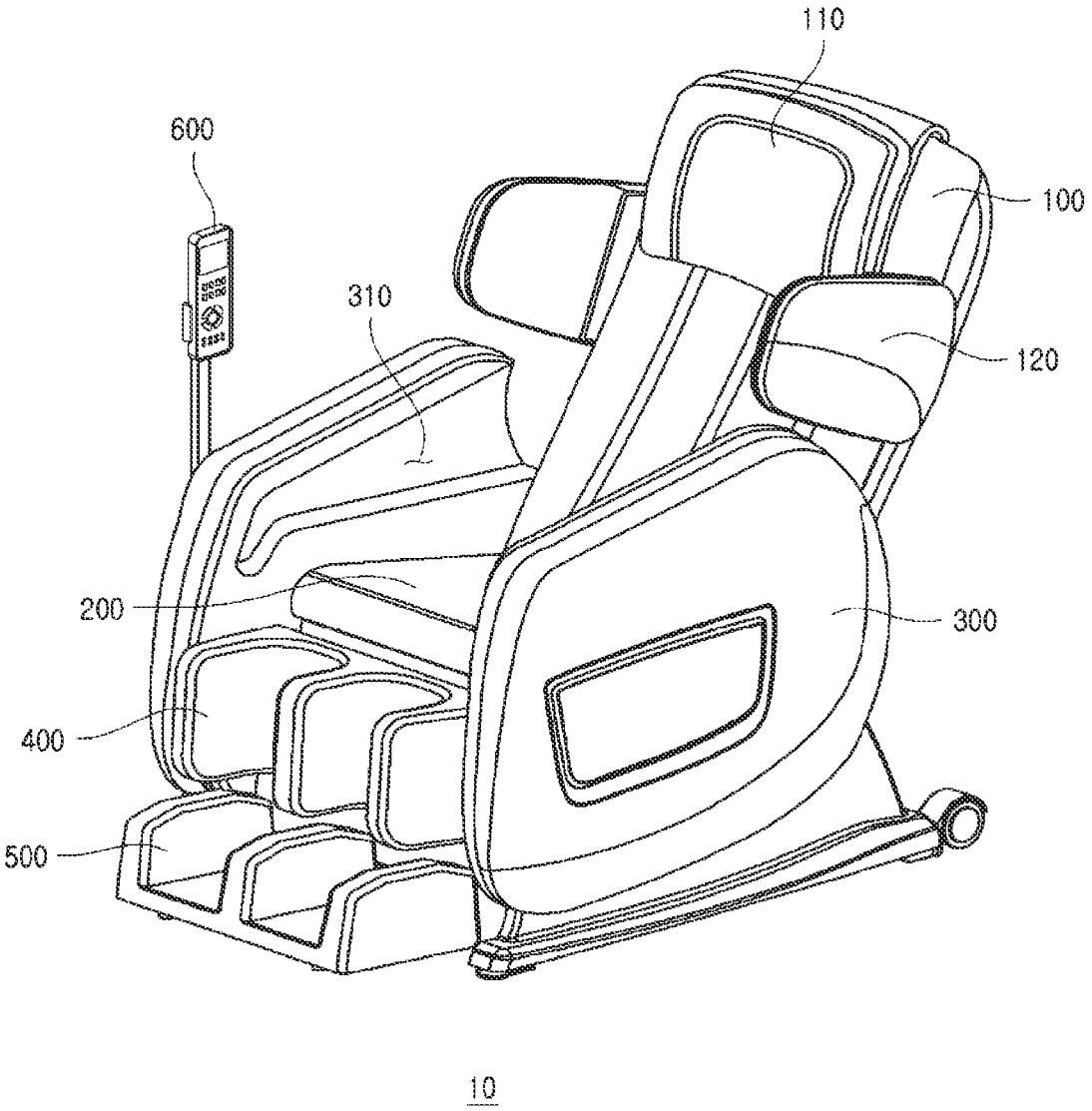
FIG. 1 is a perspective view illustrating a massage chair according to an embodiment of the present invention.

Hereinafter, the present invention will be described below with reference to the accompanying drawings.

1. Definition of Terms

With the assumption that a user is seated on a massage chair 10 in the accompanying drawings, it is described that the upper part of the user is the upper side, the lower part of the user is the lower side, the front side which the user faces is the front surface, and the direction that corresponds to the rear side, which the user faces, and which the back of the user faces is the rear surface.

A back support part 100, calf massage parts 400, and foot massage parts 500, which will be described below, may be rotated and moved upwards and downwards, and to achieve this, a separate actuator (not illustrated) is provided, which is already well known in the art, and accordingly, a detailed description of the operational principle thereof will be omitted.

Further, operations of inputting height information to a manipulation part 600, determining massage positions, and performing massages, which will be described below, are made as a corresponding signal is transmitted to a control unit (not illustrated) if a signal is applied to the manipulation part 600, which is also well known in the art, and accordingly, a detailed description thereof will be omitted.

In the following description, "acupressure" means a massage manner of giving a pressure stimulus of an aspect of pressing the narrowest portion with a thumb.

Further, "inner pressing" means a massage manner of giving a pressure stimulus of an aspect of pressing an acupuncture point and a convex portion of a palm below a thumb in a slightly wide area around the acupuncture point.

Further, "pressing" means a massage manner of giving a pressure stimulus of an aspect of pressing the widest part, that is, the femoral region muscles, the leg thigh muscles, and the like with the entire palm.

Further, "scrubbing" means a massage manner of giving a stimulus of an aspect of rubbing a body portion with a thumb, a hand back or a convex portion of a palm below a thumb, or the entire thumb.

Further, "touching" means a massage manner of giving a stimulus of an aspect of touching a body portion by using a thumb, an index finger, or all of five fingers.

Further, "rolling" means a massage manner of giving a rolling stimulus to a palm or a wide muscular surface by using a roller.

Further, "instantaneous massages" means a massage manner of rapidly tapping a body portion with a hand back, and includes "instantaneous inner pressing" and "instantaneous pressing".

Further, "main stimulus massages" means giving a massage stimulus of a middle strength or a high strength to a stimulus mode application portion in a massage stimulating method, and may generate a treatment effect during an exchange therapy. The main stimulus massages may be used to give a stimulus to main acupuncture points of the acupuncture points.

Further, "sub stimulus massages" means giving a massage stimulus of a low strength to a stimulus mode application portion in a massage stimulating method, and may generate a stabilization effect during an exchange therapy. The background massages are background massage stimuli that maintain a treatment effect by preventing a tension of the user against the main stimulus massage that generates a treatment effect.

2. Description of Massage Chair

Figure 2:
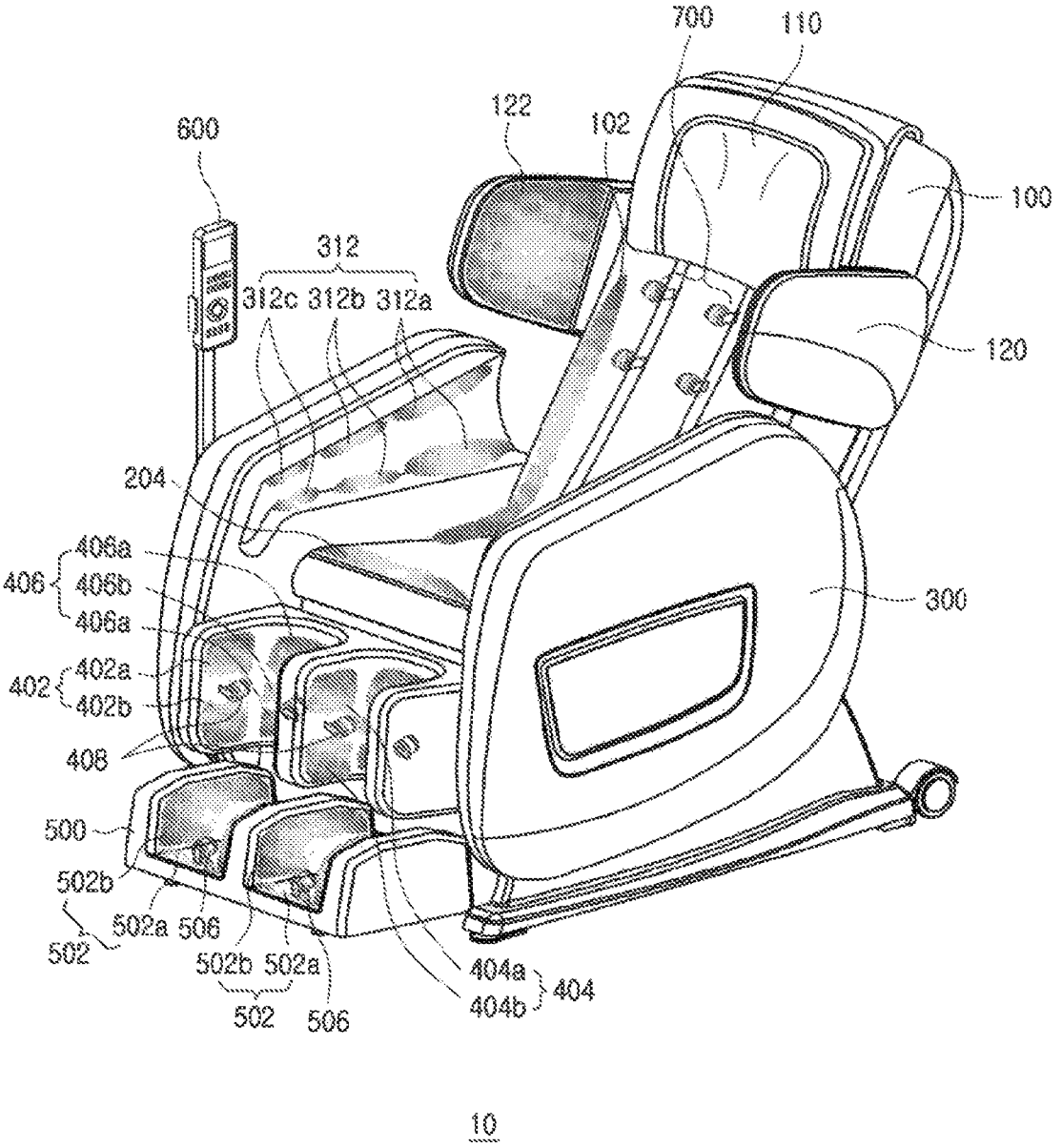
FIG. 2 is a perspective view illustrating airbags provided in the massage chair and a massage ball assembly according to the embodiment of the present invention.

Referring to FIGS. 1 and 2, a massage chair 10 according to the illustrated embodiment includes a back support part 100, a seat part 200, a support frame 300, a calf massage part 400, a foot massage part 500, and a manipulation part 600.

The back support part 100 is a part that supports the back of a user, and may be adjusted to a predetermined angle A headrest 110 which the head of the user contacts is located at an upper portion of the back support part 100.

A pair of shoulder massage part 120 are formed on the opposite left and right sides of the headrest 110 of the back support part 100, and shoulder airbags 122 that press the shoulders, respectively, are located in the shoulder massage part 120.

A pair of back airbags that extend long from the upper and lower sides of the back support part 100 and to the seat part 200, which will be described below, are located on the opposite left and right sides of the back support part 100. The back airbags 102 may press the left side and the right side of the back of the user, and may press the pelvis of the user as will be described below.

The pressure or the amount of air applied to various airbags 202, 204, 312, 402, 502, and 504, including the back airbags 102 and the shoulder airbags 122, which will be described below, may be adjusted.

The seat part 200 is a part, which upper portions of the hip and the thigh of the user contact, and generally is fixed to the support frame 300. It is preferable that the seat part 200 is formed of a material that provides a cushion feeling.

The back airbags 102 that extend are located on the left and right sides of the inside of the seat part 200. Accordingly, the back airbags 102 may press the pelvis portion as well as the back portion of the user.

The thigh airbags 204 are located on the front side of the seat part 200. The thigh airbags 204 may press the rear surfaces of the thighs of the user seated in the seat part 200.

The support frames 300 are located on the left and right sides of the seat part 200, and firmly fixes the massage chair 10 as a whole even during the operations of the back support part 100 and the calf massage parts 400 and the operation of the foot massage parts 500. To achieve this, a bracket (not illustrated) that may fix the massage chair 10 may be located on the bottom at a lower end or the support frame 300.

Arm massage parts 310 are formed on the left and right sides of the inside of the support frame 300. The arm massage parts 310 are parts, into which the arms of the user are inserted while a massage process is performed after the user is seated on the massage chair 10.

The arm airbags 312 are located on the insides of the arm massage parts 310. Each of the arm airbags 312 may include a pair of upper and lower airbags, and each of the pair of upper and lower airbags may include a pair of left and right airbags whereby each of the arm airbags 312 may include a total of four airbags.

As will be described below, each of the arm airbags 312 according to the embodiment of the present invention includes a first arm airbag 312*a*, a second arm airbag 312*b*, and a third arm airbag 312*c* on the upper and lower sides, respectively, and may massage various acupuncture point positions located at the arm portions.

The calf massage parts 400 are parts that massage leg portions of the user, in detail, the calf portions on the lower sides of the knees. The calf massage parts 400 are provided with a pair of grooves such that the calves of the user may be inserted into the pair of grooves.

The calf massage parts 400 may be moved at a predetermined angle with respect to the support part 200 and the fixed support frames 300.

An outer calf airbag 402, an inner calf airbag 404, and a rear calf airbag 406 are located on the inside of the grooves of the calf massage parts 400, respectively.

In more detail, if it is assumed that the calves of the user are inserted into the calf massage parts 400, outer calf airbags 402 that press the outer sides of the calves of the user, inner calf airbags 404 that press the inner sides of the calves of the user, and rear calf airbags 406 that press the rear sides of the calves of the user are located.

As will be described below, each of the calf airbags 402, 404, and 406 according to the embodiment of the present invention includes additional airbags 402*a*, 402*b*, 404*a*, 404*b*, 406*a*, and 406*b* on the upper and lower sides, respectively, and may massage various acupuncture point positions located at the calf portions.

Calf massage balls 408 are inserted into the opposite side surfaces of the insides of the grooves of the calf massage parts 400. As will be described below, the calf massage balls 408 may massage the acupuncture point positions located in the calves together with the calf airbags 402, 404, and 406. In order to drive the calf massage balls 408, a separate control and a separate driving means (not illustrated) may be included.

The foot massage parts 500 are located at lower distal ends of the calf massage parts 400. The foot massage parts 500 are provided with a pair of grooves such that the feet may be inserted for massage of the foot portions after the user is seated on the massage chair 10.

In the illustrated embodiment, the foot massage parts 500 may be integrally formed with the calf massage parts 400. The foot massage parts 500 may be moved upwards and downwards with respect to the calf massage parts 400, and may be appropriately adjusted according to the body size (that is, the lengths of the legs, the calves, or the thighs) of the user.

Alternatively, the foot massage parts 500 may be provided separately from the calf massage parts 400.

Foot airbags 502, foot bottom airbags (not illustrated), and foot bottom massage balls 506 are located on the insides of the grooves of the foot massage parts 500.

The foot airbags 502 press the front surfaces, the rear surfaces, and the tops of the feet. As will be described below, the foot airbags 502 include front boot airbags 502*a* and foot top airbags 502*b*, and may massage various acupuncture point positions located at foot portions.

The foot bottom airbags (not illustrated) press the bottoms of the feet.

The foot bottom massage balls 506 are inserted into the foot bottom airbags (not illustrated), and thus massages can be made by the foot bottom massage balls 506 as well as by the foot bottom airbags (not illustrated).

The manipulation part 600 is a part, by which the user manipulates an operation of the massage chair 10, and may include buttons or a touch panel. Further, a display window, by which the user may identify the operational state of the massage chair 10, may be included.

In the illustrated embodiment, the manipulation part 600 is included on the right side of the massage chair 10 to be manipulated by the right hand, or alternatively, may be included on the left side to be manipulated by the left hand.

It is preferable that a connection part that connects the manipulation part 600 and the massage chair 10 is formed of a hard material, the shape of which may be deformed to a degree, and a cable (not illustrated) that connects the manipulation part 600 and a control part (not illustrated) in the inside of the massage chair 10 may be mounted therein.

In an embodiment, the user may select various massage modes through the manipulation part 600 and apply a corresponding signal to the control part, and accordingly, the manipulation part 600 transmit a signal corresponding to the massage mode to the control part.

The signal received by the control part may operate the back support part 100, the calf massage parts 400, and the foot massage parts 500 by operating an actuator (not illustrated) of the massage chair 10, or may inject air into various airbags 102, 122, 202, 204, 312, 402, 404, 406, 502, and 504.

Further, the user may adjust a massage intensity by applying a signal to the control part through the manipulation part 600, or may control motion of the massage ball assembly 700 for massaging the acupuncture points, which will be described below.

In the embodiment of the present invention, the manipulation part 600 includes various modules 610, 620, 630, 640, 650, and 660 that may predict acupuncture points, correct the predicted acupuncture point positions, and massage the predicted acupuncture point positions. This will be described below.

3. Description of Acupuncture Points in Body and Massage Method

The massage chair 10 according to the embodiment of the present invention can massage acupuncture points according to the acupuncture points located in the body, unlike the existing massaging chairs. In order to help understanding thereof, hereinafter, among acupuncture points located in the human body, acupuncture points located around vertebrae, and a method for massaging the acupuncture points will be described.

Figure 3:
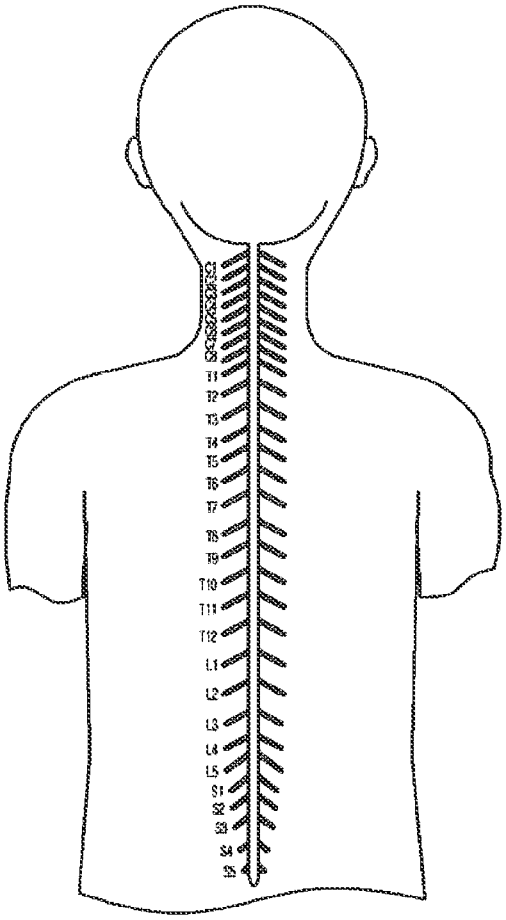
FIG. 3 is a view illustrating positions of vertebrae of a human body.
Figure 5:
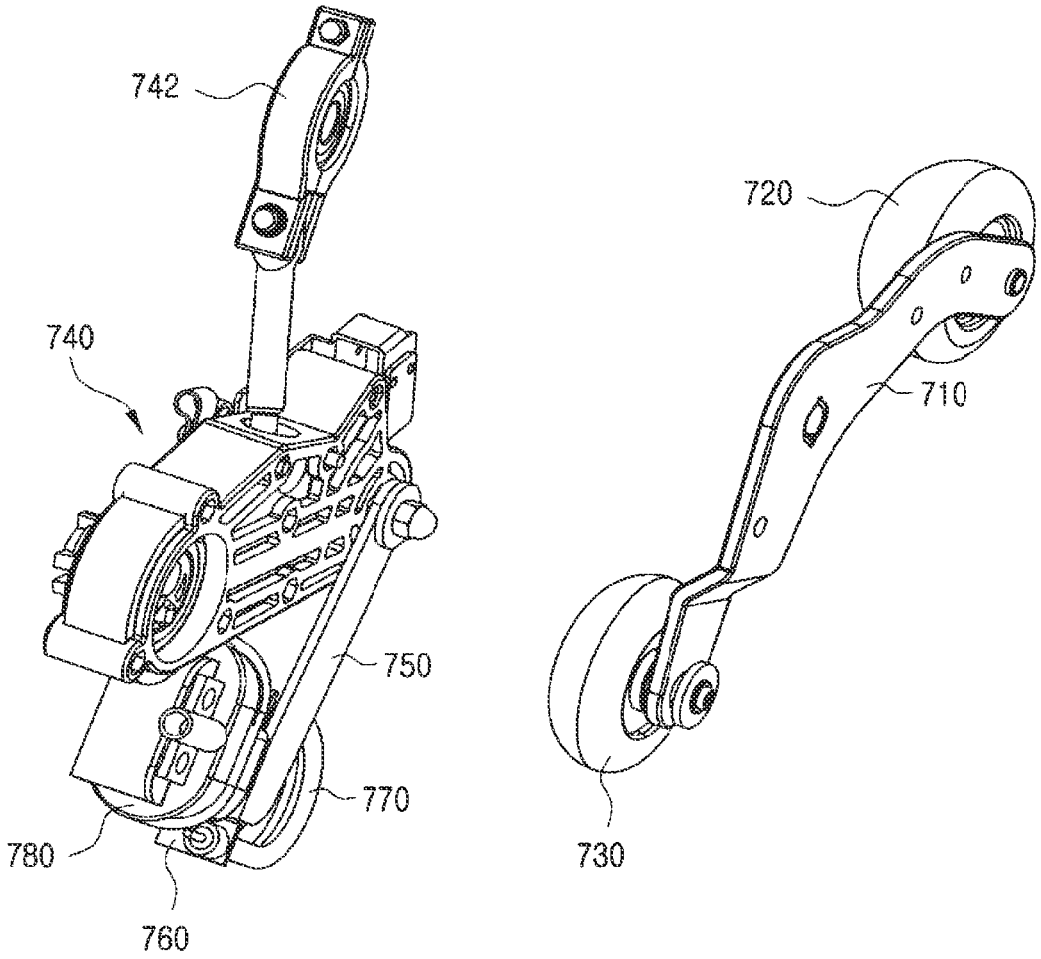
FIG. 5 is an exploded perspective view of the massage ball assembly for massaging the acupuncture points according to an embodiment of the present invention.
Figure 6:
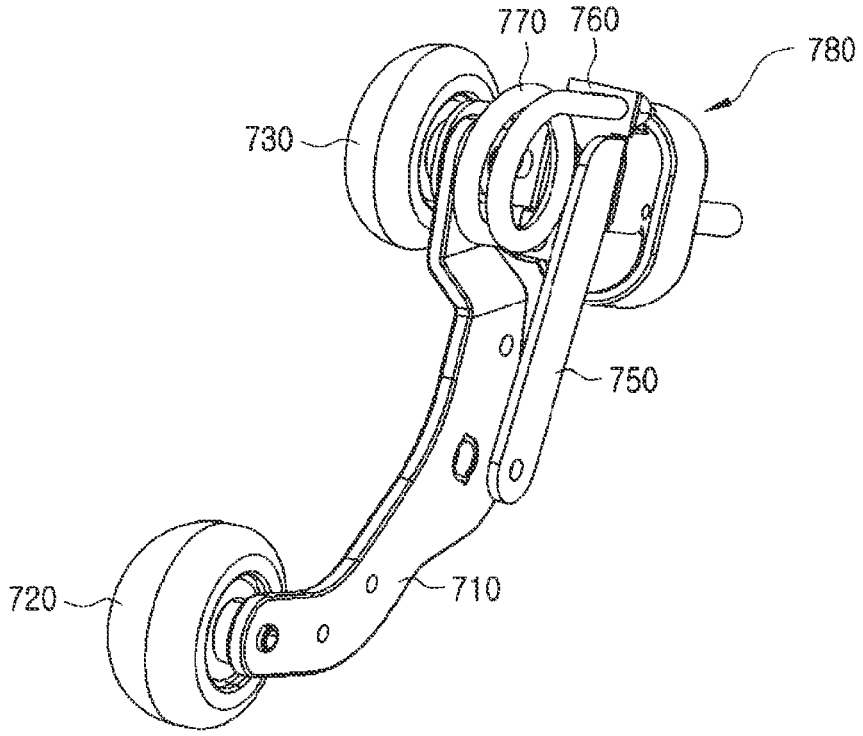
FIG. 6 is a perspective view of the massage ball assembly of FIG. 5.
Figure 7:
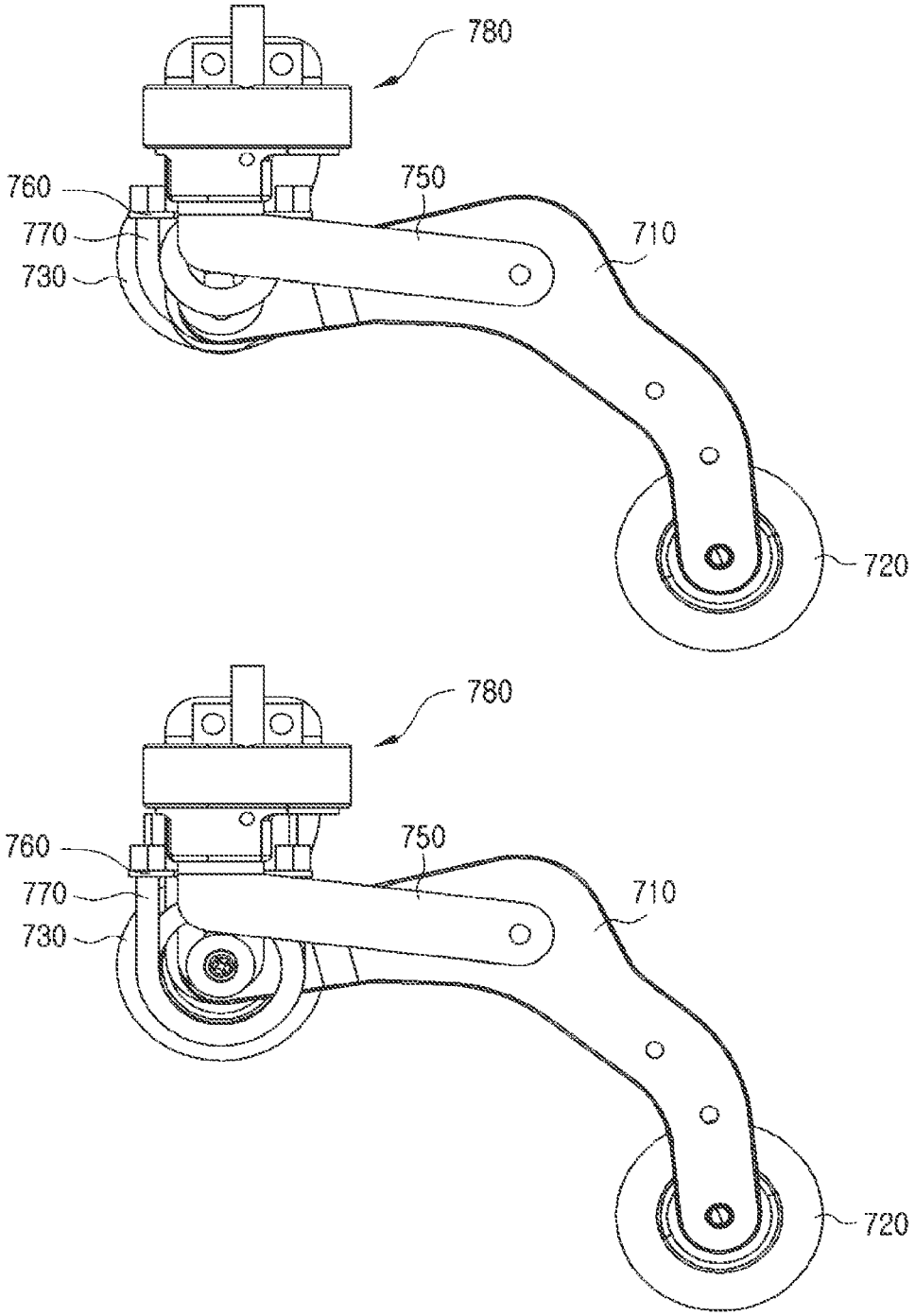
FIG. 7 is a side view of the massage ball assembly of FIG. 5.
Figure 8:
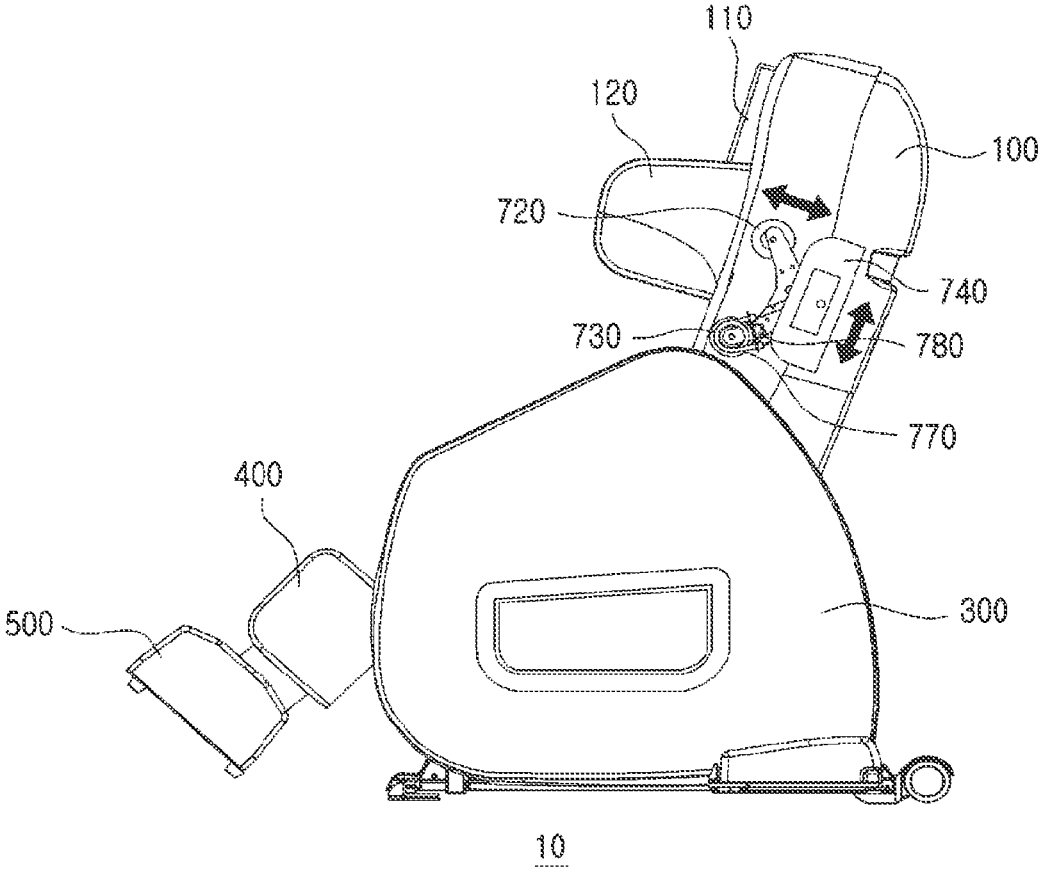
FIG. 8 is a view illustrating an appearance in which the massage ball assembly of FIG. 5 is mounted to the massage chair to be operated.

Referring to FIGS. 3 and 4, the vertebrae may be classified into C1 to S5, and the locations of the acupuncture points may be displayed with reference to the classified locations. In the following description, the terms of C1 to S5 may be used as a meaning including not only the corresponding spine portions but also the peripheries thereof.

"An myeon" is located between C1 and C2. The "an myeon" acupuncture points may be massaged through a touching or acupressure method. In more detail, a massage may be made by touching the left and right sides of the center line of cervical vertebrae or applying an acupressure to the acupuncture points.

Further, "pung bu" is located between C1 and C2. The "pung bu" acupuncture points may be massaged through a touching or acupressure method. In detail, a massage may be made by giving a touch stimulus to the left and right sides of the center line of cervical vertebrae or applying an acupressure to the acupuncture points. Then, because it is difficult to directly massage the corresponding portion of "pung bu", the closest left and right portions may be indirectly massage by giving a touch stimulus or an acupressure stimulus to the portions.

"Cheon ju" is located at C2. The "cheon ju" acupuncture points may be massaged through a touching or acupressure method. In more detail, a massage may be made by applying a touching stimulus or an acupressure to a portion of about 2 cm left and right sides of a "jeong jung seon" portion.

Further, "pung ji" is located at C2. The "pung ji" acupuncture points may be massaged through a touching or acupressure method. In more detail, a massage may be made by applying a touching stimulus or an acupressure to the vicinity of a 2/2 point of a "wan gol hyeol" extension line of a "jeong jung seon" and a "yu yang" boss below an ear "Gyeon jeong" is located at C7. The "gyeon jeong" acupuncture points may be massaged through a touching stimulus or acupressure method.

Further, "gyeon jung su" is located at C7. The "gyeon jung su" acupuncture points may be massaged through a rubbing stimulus or acupressure method.

The above-described "an myeon", "pung bu", "cheon ju", "pung ji", "gyeon jeong", and "gyeon jung su" acupuncture points are massaged by the upper massage ball 720 of the massage ball assembly 700, which will be described below, and a description thereof will be described below.

The acupuncture points of positions T1 to L5 may be massaged in the same method. The acupuncture points located at the spine portions and the massage method will be described as follows.

"Gyeon oe su" is located at T1, "ji su" is located at T2, and "sim su" is located between T5 and T6. "Yeong dae" is located between T6 and T7, and "dok su" and "eu hoe" are located between T7 and T8. "Gyeok su", "gyeok gwan", and "ji yang" are located between T8 and T9, and "hon mun" and "gan su" are located between T9 and T10.

"Dam su" and "yang gang" are located between T10 and T11, and "bi su" and "eu sa" are located between T11 and T12. "Wi su" and "wi chang" are located between T12 and L1. "Sam cho su" is located between L1 and L2, "sin su", "ji sil" and "myeong mun" are located between L2 and L3, "gi hae su" is located between L3 and L4, and "dae jang su" is located between L4 and L5.

Further, "gwan won su" is located between L4 and a sacrum and a "so jang su" and "band gwang su" are located in the sacrum.

The acupuncture points at portions from T1 to L5, which have been described above, may be massaged in methods such as acupressure, acupressure and touching, and instantaneous inner pressing. In more detail, massages may be made by applying a scrubbing stimulus to cystoscope line 1 and applying an acupressure or a scrubbing stimulus to the acupuncture points and peripheral portions around the acupuncture points. Alternatively, massages may be made by applying a touching stimulus and an instantaneous pressing stimulus to the acupuncture points and the portions around the acupuncture points.

Further, the acupuncture points at positions of a sacral vertebra and a coccyx (S1 to S5) may be massaged in the same method. The acupuncture points located at the spine portions and the massage method will be described as follows.

"Sang ryo" is located in the sacral vertebra, and "mi gol dan" and "cha ryo" are located in the coccyx.

The "sang ryo", "mi gold an", and "cha ryo" acupuncture points may be massaged in an acupressure or scrubbing method. In more detail, massages may be made by applying a scrubbing stimulus to left and right sides of the center line of the spine. Alternatively, massages may be made by applying an acupressure or a scrubbing stimulus to the portions of the acupuncture points.

Further, because it is difficult to massage "mi gold an" as "mi gol dan" is located at an end of the coccyx, indirect massages may be made by applying a scrubbing stimulus to the closest left and right portions.

The above-described "gyeon oe su", "ji su", "sim su", "yeong dae", "dok su", "eu Heo", "gyeok su", "gyeok gwan", "ji yang", "hon mun", "gan su", "dam su", "yang gang", "bi su", "eu sa", "wi su", "wi chang", "sam cho su", "sin su", "ji sil", "myeong mun", "gi hae su", "gae fang su", "gwan won su", "so fang su", "band gwang su", "sang ryo", "mi gol dan", and "cha ryo" acupuncture points are massaged by the lower massage ball 730 of the massage ball assembly 700, which will be described below, and thus a description thereof will be described below.

4. Description of Massage Method by Airbag

Referring to FIG. 2, the massage chair 10 according to the illustrated embodiment includes airbags 204, 312, 402, 404, 406, 502, 504 that may massage the above-described acupuncture points.

In another embodiment, the acupuncture points that are not located around the vertebrae are massaged by the airbags 204, 312, 402, 404, 406, 502, and 504, and a detailed description thereof will be omitted.

5. Description of Massage Ball Assembly 700

Referring to FIG. 2, the massage chair 10 according to the present invention includes a massage ball assembly 700 for massaging acupuncture points located around vertebrae.

One of the features of the massage ball assembly 700 according to the embodiment of the present invention, which is distinguished from the conventional technology, is that the upper massage balls 720, the lower massage balls 730, and the heat emitting body 770 may massage acupuncture points according to the acupuncture points and the lower massage balls 730 and the heat emitting body 770 may move linearly to precisely massage the acupuncture point positions.

In detail, as described above, the acupuncture points located around T1 to L5 perform mainly acupressure of the acupuncture points and narrow peripheral portions. However, because the existing massage ball assembly performs massage while the massage balls contact the body of the user after rotating about an axis, there is possibility of massaging locations that deviate from the measured locations of the acupuncture points upwards and downwards.

According to the massage ball assembly 700 according to the embodiment of the present invention, the lower massage balls 730 and the heat emitting body 770 are linearly moved in a direction that faces the back support part 100 and an opposite direction thereof while not rotating about the axis to precisely massage the predicted acupuncture points.

Here, the massage ball assembly 700 will be described in detail with reference to FIGS. 5 to 8.

Description of Configuration of Massage Ball Assembly 700

In the illustrated embodiment, the massage ball assembly 700 includes a first bracket 710, an upper massage ball 720, a lower massage ball 730, a massage bundle 740, a second bracket 750, a support part 760, a heat emitting body 770, and a driving part 780.

The upper massage ball 720 and the lower massage ball 730 are mounted on the first bracket 710 to be rotatable. The first bracket 710 may be mounted on the massage bundle 740 to be rotatable to be moved when the massage bundle 740 is moved upwards, downwards, leftwards, and rightwards, and accordingly, the upper massage ball 720 and the lower massage ball 730 may be moved together.

Further, the massage balls 720 and 730 that contact the back portion of the user may be selected through rotation of the first bracket 710. That is, the massage may be made only by the upper massage ball 720 or only by the lower massage ball 730, and may be made only by the heat emitting body 770.

The upper massage ball 720 is mounted on one end of the first bracket 710 to be rotatable. The upper massage ball 720 may be moved together with the first bracket 710, and may provide a massage stimulus to the user. Further, because the upper massage ball 720 may be rotated while contacting the body of the user, a rolling stimulus can be provided to the user.

The lower massage ball 730 is mounted on an opposite end of the first bracket 710 to be rotatable. The lower massage ball 730 may be moved together with the first bracket 710, and may provide a massage stimulus to the user. Further, because the lower massage ball 730 may be rotated while contacting the body of the user, a rolling stimulus can be provided to the user.

Any material that may provide an optimum massage feeding to the user and minimize noise during rotation may be the material of the upper massage ball 720 and the lower massage ball 730.

The massage bundle 740 provides power, by which the massage ball assembly 700 may be moved upwards, downwards, leftwards, and rightwards. The massage bundle 740 is provided with an actuator 742 for providing power to the massage ball assembly 700.

Further, the massage bundle 740 provides electric power supplied from a power supply part (not illustrated) to the heat emitting body 770 and the driving part 780, which will be described below, through separate electric wires (not illustrated) included in the first bracket 710 and the second bracket 750.

The massage bundle 740 may be moved in various forms. It may be moved upwards and downwards, may be moved leftwards and rightwards, and may be rotated, and also may be touched for a touching operation and may be tapped for instantaneously pressing.

That is, the massage ball assembly 700 according to the embodiment of the present invention may perform all of acupressure, inner pressing, scrubbing, touching, rolling, and instantaneous massaging.

The first bracket 710 and the second bracket 750 are mounted on the massage bundle 740 to be rotatable.

The second bracket 750 is mounted on the massage bundle 740 to be rotatable, and is connected to the support part 760, which will be described below. The motions of the lower massage ball 730 and the light emitting body 770 may be restricted to a linear motion instead of a rotation by the second bracket 750.

In detail, it is general that the first bracket 710 is mounted on the massage bundle 740 to be rotatable and the upper massage ball 720 and the lower massage ball 730 are rotated according to the motion of the massage bundle 740 or about the shaft, through which the first bracket 710 is connected to the massage bundle 740.

The driving part 780, which will be described below, may be fixed to the massage ball assembly 700 according to the embodiment of the present invention by the second bracket 750. Accordingly, because the lower massage ball 730 or the heat emitting body 770 may be linearly moved in a direction that faces the back support part 100 and an opposite direction thereof by an operation of the driving part 780, the predicted acupuncture point positions can be precisely massaged.

The driving part 780, which will be described below, is connected to one side of the support part 760. Further, the lower massage ball 730 and the heat emitting body 770 are located on an opposite side of the support part 760 to face the driving part 780.

The heat emitting body 770 provides a warm heat feeling to the user through emission of heat. Further, the heat emitting body 770 may apply a pressure stimulus to the user through emission of heat and pressing. Accordingly, the user can obtain an effect such as Moxa treatment or acupressure at a desired portion.

The driving part 780 provides power, by which the lower massage ball 730 and the heat emitting body 770 are linearly moved.

In the illustrated embodiment, the driving part 780 may include a motor. If the motor is driven, the lower massage ball 730 and the heat emitting body 770 can be linearly moved to toward the user and press a desired portion while the first bracket 710 is not moved. In more detail, the motor may perform a touch operation and may move the lower massage ball 730 and the heat emitting body 770 upwards and downwards.

In another embodiment, the driving part 780 may include an airbag. If air is injected into the airbag, the lower massage ball 730 and the heat emitting body 770 can be linearly moved to toward the user and press a desired portion while the first bracket 710 is not moved.

Alternatively, a plurality of motors may be provided and may be classified into a touch motor that may perform a touch operation and a movement motor that may move the lower massage ball 730 and the heat emitting body 770.

For an operation of the driving part 780, an electric wire (not illustrated) that supplies electric power to the motor and an air injection means (not illustrated) that injects air into an airbag may be provided.

A process of massaging acupuncture points by the massage ball assembly 700, which will be described below, is utilized when the massage ball assembly 700 massages the determination massage positions and the correction massage positions, which have been determined, in a process of massaging the acupuncture points through the manipulation part 600, which will be described below.

(2) Description of Process S510 of Massaging Acupuncture Points by Massage Ball Assembly 700

The massage ball assembly 700 may massage acupuncture points located around vertebrae by the upper massage ball 720 and the lower massage ball 730 (see FIG. 4). Hereinafter, a process of massaging acupuncture points with reference to the locations of the vertebrae will be described.

1) Description of Process of Massaging Acupuncture Points by Upper Massage Balls 720

First, it is preferable that C1 to C7, that is, the acupuncture points of the cervical vertebra are massaged by the upper massage ball 720. In order to massage the lower massage ball 730, the first bracket 710 should be rotated such that the lower massage ball 730 contacts portions C1 to C7.

In this case, the upper massage ball 720 is raised further than portion C1 by rotation of the first bracket 710, which makes it difficult to perform massages due to the structure of the massage ball assembly 700.

As described above, because massages including scrubbing or touching are made at acupuncture points located around C1 to C7, it is preferable that massages are made to peripheries of the corresponding acupuncture points rather than only to the precise locations of the acupuncture points.

Accordingly, the upper massage ball 720 is rotated through the rotation of the first bracket 710 to massage the acupuncture points of "an myeon", "pung bu", "cheon ju", "pung ji", "gyeon jeong", and "gyeon jung su" and the peripheries of the acupuncture points.

Of course, the upper massage ball 720 may be moved through the movement of the massage bundle 740 to be adjusted to the acupuncture points before the upper massage ball 720 massages the acupuncture points.

2) Description of Process of Massaging Acupuncture Points by Lower Massage Balls 730

It is preferable that T1 to L5, that is, the acupuncture points of a thoracic vertebra, a lumbar vertebra, and a sacral vertebra are massaged by the lower massage ball 730. This is because interferences may structurally occur in adjusting the widths of line 2 of cystoscope line 1 and cystoscope line 2, that is, the peripheries of about 180 mm when the upper massage ball 720 performs a massage.

As described above, because massages including an acupressure are performed on the acupuncture points located around T1 to T5, it is preferable that massages are performed on the precise locations of the acupuncture points.

Accordingly, the lower massage ball 730 is linearly moved by the driving part 780 to massage acupuncture points of "gyeon oe su", "ji su", "sim su", "yeong dae", "dok su", "eu Hoe", "gyeok su", "gyeok gwan", "ji yang", "hon mun", "gan su", "dam su", "yang gang", "bi su", "eu sa", "wi su", "wi chang", "sam cho su", "sin su", "ji sil", "myeong mun", "gi hae su", "gae jang su", "gwan won su", "so jang su", "band gwang su", "sang ryo", "mi gol dan", and "cha ryo.

Alternatively, the heat emitting body 770 located adjacent to the lower massage ball 730 may be linearly moved together to deliver the warm heat feeling while performing massages, and the heat emitting body 770 alone may be linearly moved to deliver the warm heat feeling while performing massages.

Of course, the lower massage ball 730 or the heat emitting body 770 may be moved through the movement of the massage bundle 740 to be adjusted to the acupuncture points before the lower massage ball 730 or the heat emitting body 770 massages the acupuncture points.

6. Description of Massage Process through Manipulation Part 600

The massage chair 10 according to the embodiment of the present invention performs massages by primarily detecting the shoulder height if the user is seated on the massage chair 10, predicting the hip bone positions through this, and predicting a plurality of determination massage positions and a plurality of correction massage positions spaced apart from the plurality of determination massage positions with reference to the predicted hip bone positions.

Further, the height information of the user is further input, and errors of the predicted massage positions can be reduced by correcting the predicted acupuncture point positions on the basis of the height information.

To achieve this, the manipulation part 600 includes a shoulder height measurement module 610, a hip bone position prediction module 620, a massage position determination module 630, a massage ball assembly control module 640, a user height information input module 650, and a hip bone position correction module 660.

In the following description, the plurality of determination massage positions mean massage positions determined through the hip bone positions predicted by measuring the shoulder heights, and the plurality of correction massage positions mean massage positions spaced apart upwards and downwards from the determined determination massage positions by a predetermined distance.

Further, the correction massage position located on the upper side of the determined determination massage position is referred to as a first correction massage position, and the correction massage position located on the lower side of the determined determination massage position is referred to as a second correction massage position.

Further, a distance between the determined determination massage position and the first correction massage position is referred to as a first distance, and a distance between the determined determination massage position and the second correction massage position is referred to as a second distance. Of course, the above-described predetermined distance includes the first distance and the second distance.

In an embodiment, the plurality of determination massage positions and the plurality of correction massage positions may be acupuncture point positions.

Figure 9:
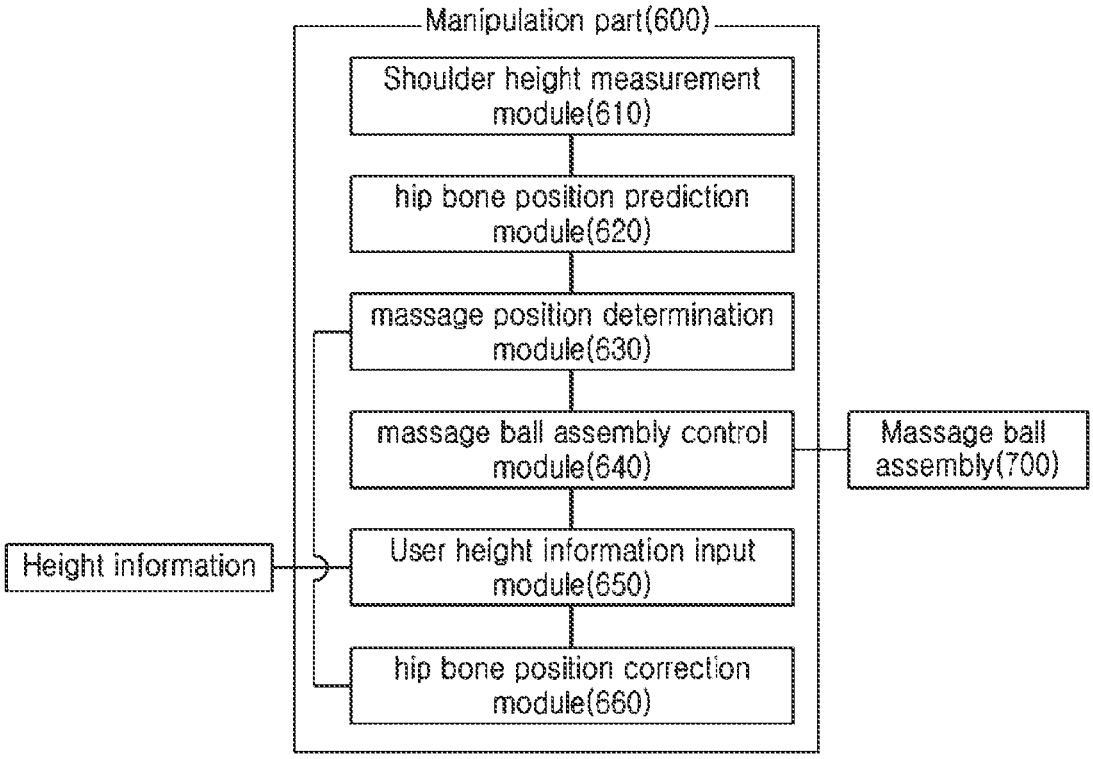
FIG. 9 is a block diagram illustrating a configuration for performing a method for correcting massage positions according to an embodiment of the present invention.
Figure 10:
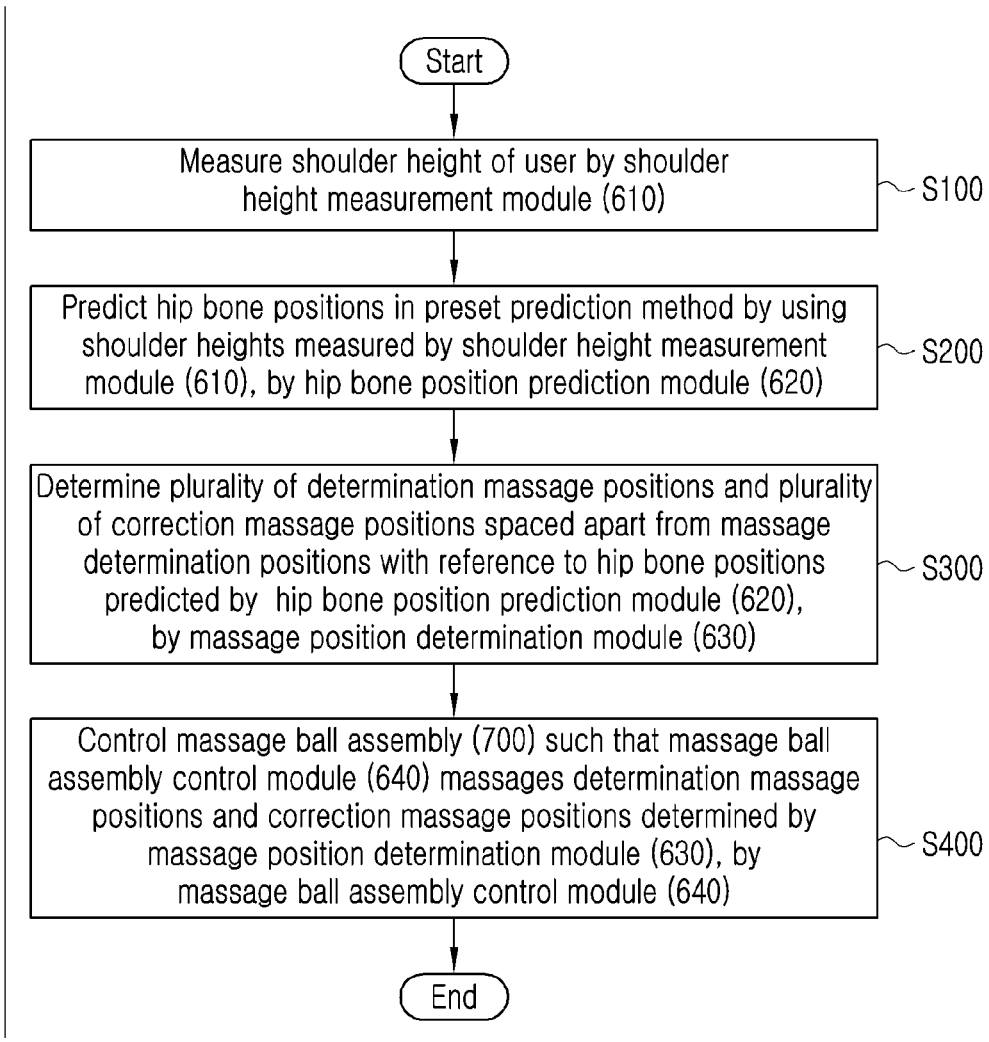
FIG. 10 is a flowchart illustrating a process of performing the method for correcting massage positions according to an embodiment of the present invention.
Figure 11:
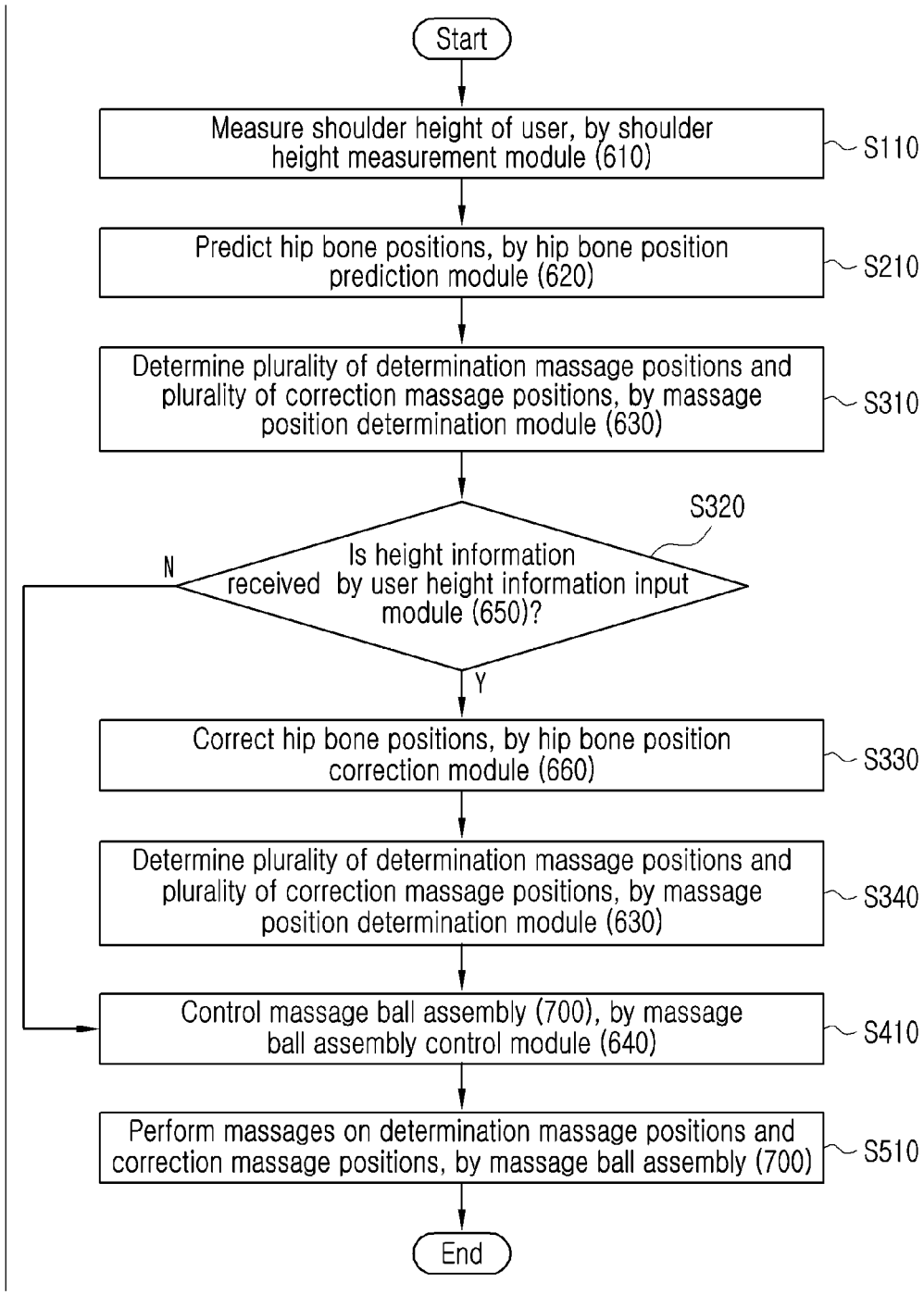
FIG. 11 is a flowchart illustrating a process of performing the method for correcting massage positions according to another embodiment of the present invention.

Hereinafter, a process of predicting the massage positions of the user and performing massages by the massage chair 10 according to the embodiment of the present invention will be described with reference to FIGS. 9 to 11.

(1) Description of Processes S100 and S110 of Measuring Shoulder Height of User by Shoulder Height Measurement Module 610

If the user is seated on the massage chair 10, the shoulder height measurement module 610 measures the shoulder height of the user. To achieve this, the massage chair 10 may include a shoulder height detection means (not illustrated).

The hip bone positions, which will be described below, is predicted to detect the shoulder height, and it is because the acupuncture point positions that are distributed at a body portion of a person may be set with reference to the hip bone positions.

Then, the hip bone positions are located in proportion to the height, and the shoulder height is also located in proportion to the height. Accordingly, the hip bone positions may be predicted by measuring the shoulder height.

(2) Description of Processes S200 and S210 of Predicting Hip Bone Positions by Hip Bone Position Prediction Module 620

As described above, the hip bone positions are predicted by the hip bone position prediction module 620 by using the shoulder height of the user measured by the shoulder height measurement module 610. To achieve this, a body information database (not illustrated) that stores big data, in which a correlation between the height, the hip bone positions, the shoulder heights of a person are mapped may be further included.

In more detail, the hip bone position prediction module 620 groups the measured shoulder heights according to the heights first to predict the hip bone positions. As an example, the shoulder heights may be classified into a total of 19 stages including first to 19-th stages. Then, the lowest shoulder height may be classified as stage 1, and the highest shoulder height may be classified as stage 19.

If the measured shoulder height is classified as a specific stage, the hip bone position prediction module 620 compares the stage of the measured shoulder height with a first shoulder height value and a second shoulder height value.

Then, the first shoulder height value is determined to be smaller than the second shoulder height value. That is, the measured shoulder heights may be classified into any one of three groups according to the first shoulder height value and the second shoulder height value. As an example, the first shoulder height value may be determined to be stage 10 and the second shoulder height value may be determined to be stage 13.

When the measured shoulder height is less than the first shoulder height value, the hip bone position prediction module 620 predicts the hip bone position as the first hip bone position value. As an example, the first hip bone position value may be 'low'.

When the measured shoulder height is not less than the first shoulder height value and less than the second shoulder height value, the hip bone position prediction module 620 predicts the hip bone position as the second hip bone position value. As an example, the second hip bone position value may be 'middle'.

When the measured shoulder height is not less than the second shoulder height value, the hip bone position prediction module 620 predicts the hip bone position as the third hip bone position value. As an example, the third hip bone position value may be 'high'.

That is, the second hip bone position value may be set to be larger than the first hip bone position value, and be smaller than the third hip bone position value.

(3) Description of Processes S300 and S310 of Determining Plurality of Determination Massage Positions and Plurality of Correction Massage Positions by Massage Position Determination Module 630.

If the hip bone position is predicted, the massage position determination module 630 determines a plurality of determination massage positions and a plurality of correction massage positions with reference to the predicted hip bone positions.

As described above, the hip bone position has a close relation with the acupuncture point positions distributed in the body. In order to determine the determination massage positions, the massage position determination module 630 may include an acupuncture point position database (not illustrated) in which a correlation of the hip bone position and the acupuncture point positions distributed in the body is mapped and stored If the plurality of determination massage positions are determined, the massage position determination module 630 determines a plurality of correction massage positions spaced apart from the plurality of determination massage positions by a predetermined distance. In more detail, the correction massage positions are a plurality of positions spaced apart upwards and downwards from the determination massage positions determined according to the positions of vertebrae that are adjacent to the determined determination massage positions.

In an embodiment, the correction massage positions may be a first correction massage position spaced apart upwards by a first distance, and a second correction massage positions spaced apart downwards by a second distance.

The, the shoulder height measured by the shoulder height measurement module 610 is portion C7 and the hip bone position predicted by the hip bone position prediction module 620 is portion L4 whereby portion C7 to L4, that is, a total of 17 positions of vertebrae are located between the shoulder height and the hip bone positions.

Accordingly, a total of 16 intervals are present between portion C7 and portion L4.

However, the intervals between the vertebrae are not the same. Accordingly, the distances between the determined determination massage positions and the plurality of correction massage positions may be different according to the portions (positions of the vertebrae) of the determined determination massage positions Further, the intervals between the vertebra portions also may be different according to the height of the user and the hip bone positions.

Accordingly, because the changes in the intervals between the vertebrae cannot be reflected if the distances between the determined determination massage positions and the plurality of correction massage positions are determined to be absolute values, it is difficult to precisely predict the acupuncture point positions of a specific user.

Further, it is difficult to precisely predict the acupuncture point positions that may be changed according to the users due to the heights or the users or the like.

Accordingly, in the embodiment of the present invention, in consideration that the intervals between the vertebra portions are gradually larger, the positions moved from the positions of the vertebra portions by one vertebra position in the upward/downward direction is determined as the plurality of correction massage positions.

For example, if the determined determination massage position is portion T6, portion T5 on the upper side and portion T7 on the lower side are determined as the plurality of correction massage positions. This is because the lengths of the intervals between the vertebrae changed according to the height of the user related to the hip bone position of the user can be reflected.

Accordingly, the predetermined distances between the plurality of determined determination massage positions and the plurality of correction massage positions can be changed according to the positions of the vertebrae that are adjacent to the determined determination massage positions. Because the intervals between different vertebra portions of the same user are reflected, the errors of the predicted acupuncture point positions can be reduced.

Further, because the intervals between the vertebra portions that may be different according to the user due to the height also are reflected, the errors of the predicted acupuncture point positions can be reduced.

In an embodiment, the massage position determination module 630 determines a plurality of massage positions distributed along the vertebrae, and each of the plurality of determination massage positions includes one determination massage position and two correction massage positions determined accordingly such that a total of three determination massage positions are determined for each of the massage positions.

(4) Description of Processes S400 and S410 of Controlling Massage Ball Assembly 700 by Massage Ball Assembly Control Module 640

If the plurality of determination massage positions and the plurality of correction massage positions are determined, the massage ball assembly control module 640 controls the massage ball assembly 700 to massage the plurality of determination massage positions and the plurality of correction massage positions, which have been determined.

First, the massage ball assembly control module 640 controls the massage ball assembly 700 to massage the plurality of determined determination massage positions. Then, the massage method of the massage ball assembly 700 may be progressed in the methods described above in 3. and 5. (2).

If the massage ball assembly 700 performs massages on the plurality of determined massage positions, the massage ball assembly 700 moves to the plurality of correction massage positions. Then, the massage ball assembly 700 moves in a predetermined movement manner, that is, a scrubbing manner when moving to the correction massage positions.

In more detail, as described above "scrubbing" means a massage manner of giving a stimulus of an aspect of rubbing a body portion with a thumb, a hand blade or a convex portion of a palm below a thumb, or the entire thumb.

In order to give a scrubbing stimulus, the massage ball assembly 700 moves while moving circularly when moving from the determined determination massage positions to the correction massage positions, and the center of rotation then is the vertebra.

The massage ball assembly 700 may move to the first correction massage position on the upper side first, and may move to the second correction massage position on the lower side first. That is, the movement sequence is not limited. Hereinafter, it is assumed that the massage ball assembly 700 moves to the first correction massage position first.

If the massage ball assembly 700 reaches the first correction massage position, the first correction massage position is massaged in the method described above in 3. and 5. (2).

If the first correction massage position is completely massaged, the massage ball assembly 700 moves to the second correction massage position. Then, the massage ball assembly 700 also moves while circularly rotating as described above.

Of course, when tem massage ball assembly 700 moves from the first correction massage position to the second massage position, it may additionally perform massages to the determined determination massage positions while passing through the determined determination massage positions.

The massage ball assembly 700 which has reached the second correction massage position performs massages on the second correction massage position in the method described above in 3. and 5. (2).

That is, the massage ball assembly control module 640 controls the massage ball assembly 700 such that the massage ball assembly 700 massages the determined determination massage position, both the first correction massage positions and the second correction massage positions, and moves in a scrubbing manner, that is, while circularly rotating between the first correction massage position the second correction massage position to additionally perform massages.

Accordingly, the errors of the determination massage positions determined according to the intervals of the vertebra portions that may be changed according to the body shape of a person can be minimized by massaging the determined determination massage positions and the plurality of correction massage positions, that is, the predicted acupuncture point positions and the acupuncture point positions in the vicinity thereof (5) Receiving Height Information of User by User Height Information Input Module In the embodiment of the present disclosure, the user may input height information of the user through the manipulation part 600. In more detail the height information of the user is input trough the user height information input module 650.

This is because the error of prediction of the hip bone positions can be reduced by predicting the hip bone positions with reference the shoulder height, and correcting the predicted hip bone positions with reference to the height of the user.

The height information of the user input by the user height information input module 650 is utilized to correct the hip bone position.

(6) Description of Process S330 of Correcting Hip Bone Positions by Hip Bone Position Correction Module 660

As described above, the user height information input module 650 may receive the height information of the user. Further, the hip bone positions may be located in proportion to the height.

The hip bone position correction module 660 corrects the hip bone positions predicted by the hip bone position prediction module 620 by using the height information of the user. To achieve this, the hip bone position correction module 660 may further include a body information database (not illustrated).

(7) Description of Process S340 of Determining Plurality of Determination Massage Positions and Plurality of Correction Massage Positions by Massage Position Determination Module 630

If the hip bone position correction module 660 corrects the hip bone positions, the massage position determination module 630 determines the plurality of determination massage positions and the plurality of correction massage positions again with reference to the hip bone positions.

Then, the process of determining the plurality of determination massage positions and the plurality of correction massage positions by the massage position determination module 630 is as described in (3), and the difference lies in that the determination reference is changed to the corrected hip bone positions.

(8) Description of Process S410 of Controlling Massage Ball Assembly 700 by Massage Ball Assembly Control Module 640

If the massage position determination module 630 determines the plurality of determination massage positions and the plurality of correction massage positions, the massage ball assembly control module 640 controls the massage ball assembly 700.

The process of performing massages on the determination massage positions and the correction massage positions, which have been determined, by the massage ball assembly 700 controlled by the massage ball assembly control module 640 is as described as in (4).

Although the preferred embodiment of the present invention has been described until now, it can be understood by an ordinary person in the art that the present invention may be variously corrected and changed without departing from the spirit and area of the present invention described in the claims.

DESCRIPTION OF REFERENCE NUMERALS

10: Massage chair
100: Back support
102: Back airbag
110: Headrest
120: Shoulder massage part
122: Shoulder airbag
200: Seat part
204: Thigh airbag
300: Support frame
310: Arm massage part
312: Arm airbag
312*a*: First arm airbag
311*b*: Second arm airbag
311*c*: Third arm airbag
400: Calf massage part
402: Outer calf airbag
402*a*: First outer calf airbag
402*b*: Second outer calf airbag
404: Inner calf airbag
404*a*: First inner calf airbag
404*b*: Second inner calf airbag
406: Rear calf airbag
406*a*: First rear calf airbag
406*b*: Second rear calf airbag
408: Calf massage ball
500: Foot massage part
502: Foot airbag
502*a*: Front foot airbag
502*b*: Foot back airbag
506: Foot bottom massage ball
600: Manipulation part
610: Shoulder height measurement module
620: Hip bone position prediction module
630: Massage position determination module
640: Massage ball assembly control module
650: User height information input module
660: Hip bone position correction module
700: Massage ball assembly
710: First bracket
720: Upper massage ball
730: Lower massage ball
740: Massage bundle
742: Actuator
750: Secnd bracket
760: Support part
770: Heat emitting body
780: Driving part

The invention claimed is:

1. A method for correcting massage positions, the method comprising:

(a) measuring the shoulder height of a user, by a shoulder height measurement module;

(b) predicting a hip bone position through a preset prediction method by using the shoulder height measured by the shoulder height measurement module, by a hip bone position prediction module;

(c) determining a plurality of determination massage positions and a plurality of correction massage positions spaced apart from the determination massage positions by predetermined distances with reference to the hip bone position predicted by the hip bone position prediction module, by a massage position determination module; and (d) controlling a massage ball assembly to massage the determination massage positions and the correction massage positions determined by the massage position determination module, by a massage ball assembly control module, wherein the predetermined distances comprise a first distance and a second distance, wherein the correction massage positions comprise a first correction massage position spaced by the first distance to an upper side of the determination massage positions and a second correction massage position spaced by the second distance to a lower side of the determination massage positions, and wherein the first distance and the second distance are different according to positions of vertebrae that are adjacent to the massage positions, and wherein the preset prediction method comprises:

when the shoulder height measured in (a) is less than a first shoulder height value, predicting the hip bone position as a predetermined first hip bone position, by the hip bone position prediction module:

when the shoulder height measured in (a) is not less than the first shoulder height value and less than a predetermined second shoulder height value, predicting the hip bone position as a predetermined second hip bone position, by the hip bone position prediction module; and when the shoulder height measured in (a) is not less than the second shoulder height value, predicting the hip bone position as a predetermined third hip bone position, by the hip bone position prediction module, wherein the second shoulder height value is larger than the first shoulder height value, and wherein the second hip bone position value is larger than the first hip bone position value and is smaller the third hip bone position value.

2. The method of claim 1, further comprising:

after (d), (e) massaging the determination massage positions, by the massage ball assembly;

(f) moving the massage ball assembly through a preset movement scheme when the massage ball assembly is moved from the determination massage positions to the correction massage positions; and (e) massaging the correction massage positions, by the massage ball assembly, wherein in the preset movement scheme, the massage ball assembly is moved while being rotated circularly.

3. The method of claim 1, further comprising:

after (c) and before (d), (c1) receiving height information of the user, by a user height information input module; and (c2) correcting the hip bone position predicted by the hip bone position prediction module by using the height information received by the user height information input module, by a hip bone position correction module.

4. The method of claim 3, wherein (c) further comprises:

determining the plurality of determination massage positions and the plurality of correction massage positions spaced apart from the determination massage positions by the predetermined distances with reference to the hip bone position corrected by the hip bone position correction module, by the massage position determination module.

5. A massage chair that performs the method for correcting massage positions according to claim 1, wherein the massage chair comprises:

a control panel comprising the shoulder height measurement module, the hip bone position prediction module, the massage position determination module, and the massage ball assembly control module; and a massage ball assembly which massages the determination massage positions and the correction massage positions as determined by the control panel.

* * * * *